US009664056B2

(12) United States Patent
Hogberg et al.

(10) Patent No.: US 9,664,056 B2
(45) Date of Patent: May 30, 2017

(54) TURBINE SYSTEM AND ADAPTER

(71) Applicant: GENERAL ELECTRIC COMPANY, Schenectady, NY (US)

(72) Inventors: Nicholas Alvin Hogberg, Greenville, SC (US); Andres Jose Garcia-Crespo, Greenville, SC (US)

(73) Assignee: General Electric Company, Schenectady, NY (US)

( * ) Notice: Subject to any disclaimer, the term of this patent is extended or adjusted under 35 U.S.C. 154(b) by 778 days.

(21) Appl. No.: 13/974,150

(22) Filed: Aug. 23, 2013

(65) Prior Publication Data

US 2015/0056080 A1 Feb. 26, 2015

(51) Int. Cl.
*F01D 5/30* (2006.01)
*F01D 5/32* (2006.01)

(52) U.S. Cl.
CPC ..... *F01D 5/3015* (2013.01); *F01D 5/3007* (2013.01); *F01D 5/3084* (2013.01); *F01D 5/326* (2013.01)

(58) Field of Classification Search
CPC ..... F01D 5/3015; F01D 5/326; F01D 5/3084; F01D 5/3007
See application file for complete search history.

(56) References Cited

U.S. PATENT DOCUMENTS 4,084,922 A 4/1978 Glenn
4,094,615 A 6/1978 Glenn
4,111,603 A 9/1978 Stahl
4,142,836 A 3/1979 Glenn
4,904,160 A 2/1990 Partington
5,222,865 A 6/1993 Corsmeier
5,372,481 A 12/1994 Boyd
5,405,245 A 4/1995 Cornelius
(Continued)

FOREIGN PATENT DOCUMENTS

CN 1046206 A 10/1990
CN 102245859 A 11/2011
CN 103046968 A 4/2013

OTHER PUBLICATIONS

Unofficial English Translation of Chinese Office Action issued in connection with corresponding CN Application No. 201410418321.3 on Oct. 10, 2016.

*Primary Examiner* — Zelalem Eshete
(74) *Attorney, Agent, or Firm* — McNees Wallace & Nurick LLC

(57) ABSTRACT

A turbine system and adapter are disclosed. The adapter includes a turbine attachment portion having a first geometry arranged to receive a corresponding geometry of a wheelpost of a turbine rotor, and a bucket attachment portion having a second geometry arranged to receive a corresponding geometry of a root portion of a non-metallic turbine bucket. Another adapter includes a turbine attachment portion arranged to receive a plurality of wheelposts of a turbine rotor, and a bucket attachment portion arranged to receive a plurality of non-metallic turbine buckets having single dovetail configuration root portions. The turbine system includes a turbine rotor wheel configured to receive metal buckets, at least one adapter secured to at least one wheelpost on the turbine rotor wheel, and at least one non-metallic bucket secured to the at least one adapter.

20 Claims, 4 Drawing Sheets

(56) References Cited

U.S. PATENT DOCUMENTS

| | | | | |
|---|---|---|---|---|
| 5,431,541 | A | 7/1995 | Shaffer | |
| 5,435,693 | A | 7/1995 | Shaffer | |
| 5,580,219 | A | 12/1996 | Frey et al. | |
| 5,743,713 | A | 4/1998 | Hattori et al. | |
| 6,267,558 | B1 * | 7/2001 | Dingwell | F01D 5/3092 416/219 R |
| 6,416,276 | B1 | 7/2002 | Marmilic et al. | |
| 6,488,473 | B1 * | 12/2002 | Lee | F01D 5/3015 416/204 A |
| 7,094,021 | B2 | 8/2006 | Haubert | |
| 7,284,958 | B2 * | 10/2007 | Dundas | F01D 5/3007 416/193 A |
| 2011/0311366 | A1 | 12/2011 | Chanteloup | |
| 2012/0051924 | A1 | 3/2012 | Garcia-Crespo et al. | |
| 2012/0275920 | A1 | 11/2012 | Delvaux et al. | |
| 2013/0094968 | A1 | 4/2013 | Garcia-Crespo et al. | |

* cited by examiner

TURBINE SYSTEM AND ADAPTER

STATEMENT REGARDING FEDERALLY SPONSORED RESEARCH OR DEVELOPMENT

This invention was made with government support under contract number DE-FC26-05NT42643 awarded by the Department of Energy. The government has certain rights in the invention.

FIELD OF THE INVENTION

The present invention is directed to a turbine system and adapter. More specifically, the present invention is directed to a turbine system securing buckets with an adapter and an adapter for securing buckets to the turbine system.

BACKGROUND OF THE INVENTION

Turbine systems include buckets extending radially outward from rotor wheels. The buckets generally include a root portion, a substantially planar platform, and an airfoil portion. To increase the efficiency of the turbine systems, increased operating temperatures and materials which can withstand the increased operating temperatures are continually being sought. As advancements in materials are made, the construction and/or configuration of the buckets can change.

One material advancement includes the development of non-metallic buckets such as ceramic, ceramic matrix composite (CMC), or metal matrix composite (MMC) buckets, which have increased temperature capability as compared to metal and/or metal alloy buckets. Although the increased temperature capability of the non-metallic buckets would increase the efficiency of existing turbine systems, the non-metallic buckets often have differing root portions from existing metal and/or metal alloy buckets. For example, non-metallic buckets often include a dovetail-shaped root portion, whereas the metal and/or metal alloy buckets they are replacing often include a conventional fir tree-type root portion.

Many existing turbine systems have wheels or rotors that are configured to receive the conventional fir tree-type root portion of the metal and/or metal alloy bucket, and not the dovetail-shaped root portion of the non-metallic buckets. As such, many current turbine systems do not permit direct field replacement of existing metal and/or metal alloy buckets with non-metallic buckets without excessive cost and additional complexity. Furthermore, thermal expansion of the non-metallic buckets differs from the thermal expansion of the metal and/or metal alloy buckets. Attaching the non-metallic bucket to the rotor wheel configured to receive the metal and/or metal alloy bucket may cause damage to the metal and/or ceramic at their interface, as the materials expand at different rates leading to damage of the bucket where attached to the rotor wheel.

A turbine system and adapter that do not suffer from one or more of the above drawbacks would be desirable in the art.

BRIEF DESCRIPTION OF THE INVENTION

In an exemplary embodiment, an adapter includes a turbine attachment portion having a first geometry arranged to receive a corresponding geometry of a wheelpost of a turbine rotor, and a bucket attachment portion having a second geometry arranged to receive a corresponding geometry of a root portion of a non-metallic turbine bucket.

In another exemplary embodiment, an adapter includes a turbine attachment portion arranged to receive a plurality of wheelposts of a turbine rotor, and a bucket attachment portion arranged to receive a plurality of non-metallic turbine buckets having single dovetail configuration root portions.

In another exemplary embodiment, a turbine system includes a turbine rotor wheel configured to receive metal buckets, at least one adapter secured to at least one wheelpost on the turbine rotor wheel, and at least one non-metallic bucket secured to the at least one adapter. The at least one non-metallic bucket is selected from the group of materials consisting of ceramic, ceramic matrix composite, intermetallic compounds, and metal matrix composite.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are a turbine system and adapter. Embodiments of the present disclosure, in comparison to systems and articles not using one or more of the features disclosed herein, increase system temperature capabilities, increase efficiency, decrease cost, decrease fatigue failure, decrease cooling flow, provide for a use of non-metallic buckets on turbine rotors configured for metal buckets, or a combination thereof. As used herein, non-metallic buckets include ceramic buckets, ceramic matrix composite (CMC) buckets, metal matrix composite (MMC) buckets, and buckets made from intermetallic compounds.

Figure 1A:
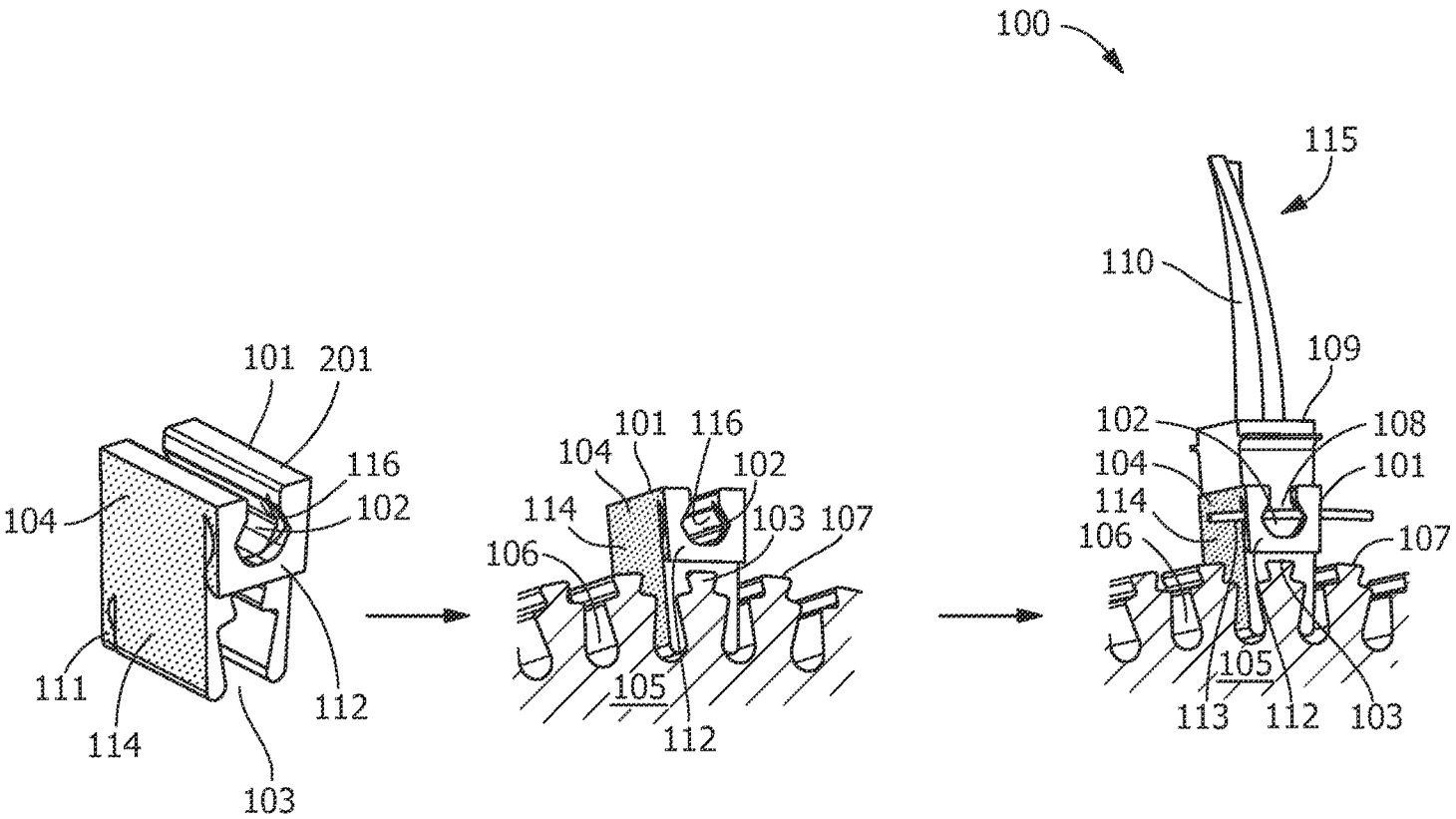
FIG. 1A is an assembly view of an adapter for a turbine system, according to an embodiment of the disclosure.
Figure 1B:
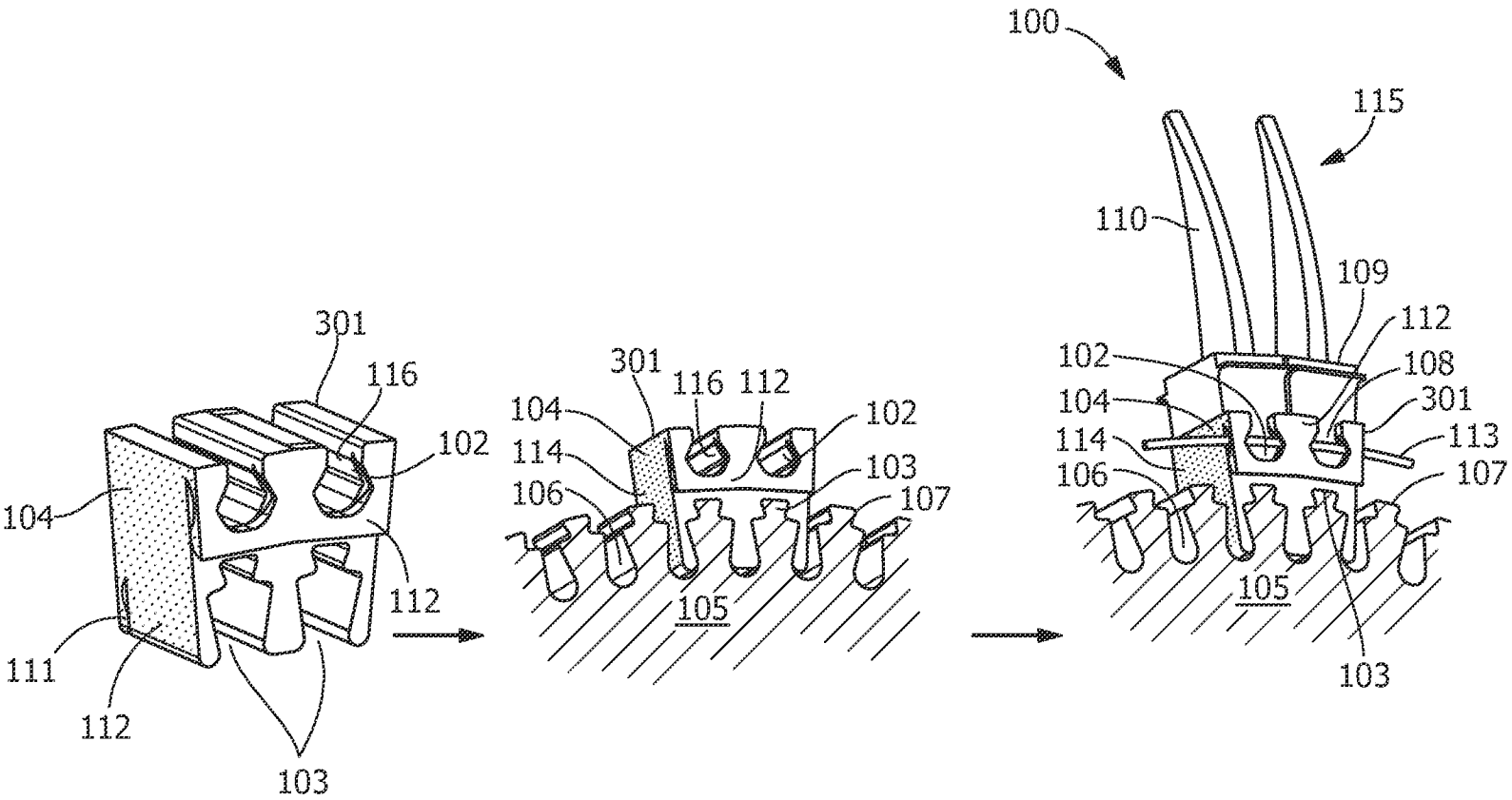
FIG. 1B is an assembly view of an adapter for a turbine system, according to an alternate embodiment of the disclosure.

Referring to FIG. 1A and FIG. 1B, in one embodiment, a turbine system 100 includes at least an adapter 101, a turbine rotor 105, and a non-metallic turbine bucket 115. The adapter 101 includes one or more turbine attachment portions 103 having a first geometry arranged to receive a corresponding geometry of a wheelpost 107 of the turbine rotor 105, and one or more bucket attachment portions 102 having a second geometry arranged to receive a corresponding geometry of a root portion 108 of the non-metallic turbine bucket 115. Sliding the turbine attachment portion 103 into turbine rotor 105 over one or more of the wheelposts 107 couples the adapter 101 to the turbine rotor 105. Inserting the root portion 108 of the turbine bucket 115 into the bucket attachment portion 102 couples the turbine bucket 115 to the adapter 101.

Figure 3:
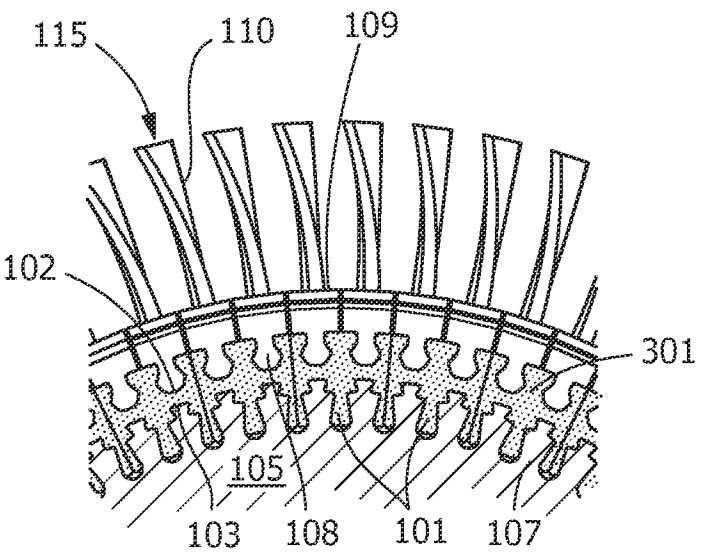
FIG. 3 is a front view of a plurality of buckets and adapters attached to a turbine system, according to an alternate embodiment of the disclosure.
Figure 2:
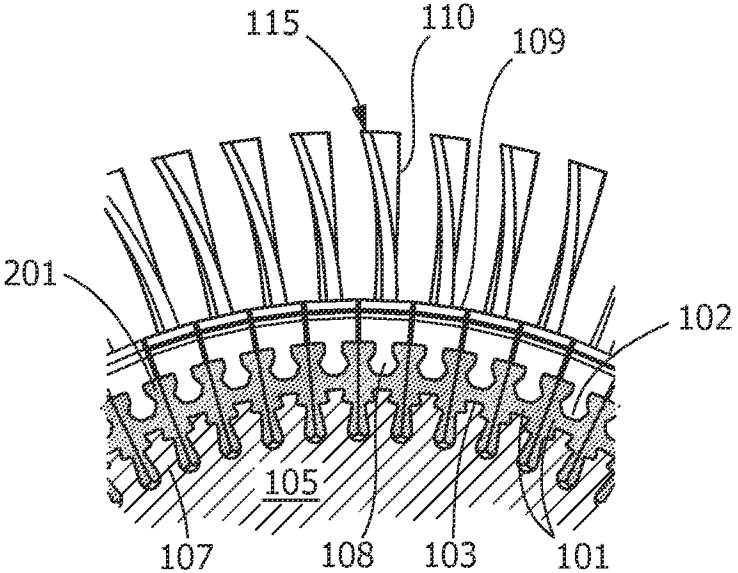
FIG. 2 is a front view of a plurality of buckets and adapters attached to a turbine system, according to an embodiment of the disclosure.

Referring to FIG. 1A and FIG. 2, in one embodiment, a single blade adapter 201 includes one of the turbine attachment portions 103 and one of the bucket attachment portions 102. Referring to FIG. 1B and FIG. 3, in one embodiment, a multiple blade adapter 301 has a plurality of turbine attachment portions 103 for sliding into turbine rotor 105 over a plurality of the wheelposts 107, and each multiple blade adapter 301 has a plurality of bucket attachment portions 102 for accepting a plurality of the turbine buckets 115.

The wheelpost 107 corresponds to the configuration of the receiving portion 106 of the turbine rotor 105. The receiving portion 106 of the turbine rotor 105 includes any suitable configuration such as, but not limited to, a single-tang, a multi-tang, a conventional fir tree-type, or a combination thereof. The first geometry of the turbine attachment portion 103 includes any suitable configuration for sliding into turbine rotor 105 over one or more of the wheelposts 107, instead of within a receiving portion 106 between the wheelposts 107. Configuring the adapter 101 to slide into turbine rotor 105 over one or more of the wheelposts 107 increases an area of the adapter 101 as compared to an article that is inserted within the receiving portion 106 of the turbine rotor 105. The increased area of the adapter 101 decreases bending stress of the adapter 101 as bending moments are applied to the turbine bucket 115. The decrease in the bending of the adapter 101 is otherwise referred to as a resistance to a bending moment.

The turbine bucket 115 includes the root portion 108, a platform 109 and an airfoil portion 110. The root portion 108 of the turbine bucket 115 includes any suitable configuration such as, but not limited to, single-tang dovetails, multi-tang (two or more) dovetails, skewed dovetail, non-skewed dovetail, or a combination thereof. The bucket attachment portion 102 of the adapter 101 includes any suitable configuration for receiving the root portion 108 of the turbine bucket 115. Suitable configurations for receiving the root portion 108 of the turbine bucket 115 include, but are not limited to, zero skew angle dovetails, non-zero skew angle dovetails, curved dovetails, or a combination thereof. The root portion 108 of the turbine bucket is slid into the bucket attachment portion 102, securing the turbine bucket 115 against radial movement relative to the adapter 101.

In one embodiment, the root portion 108 of the turbine bucket 115 differs from the receiving portion 106 of the turbine rotor 105. The adapter 101 permits attachment of the turbine bucket 115 to the turbine rotor 105 when the root portion 108 differs from the receiving portion 106. For example, in one embodiment, the turbine attachment portion 103 of the adapter 101 is configured to slide into the turbine rotor 105 over one or more of the wheelposts 107 between the receiving portions 106 having the conventional fir tree-type configuration. In another embodiment, the bucket attachment portion 102 of the adapter 101 is configured to receive the turbine bucket 115 having the single-tang dovetail configuration, thus permitting attachment of the single-tang dovetail to the conventional fir tree-type configuration.

In one embodiment, the adapter 101 includes a turbine rotor interface in the turbine attachment portion 103 and a bucket interface in the bucket attachment portion 102. The turbine rotor interface includes any suitable composition for reducing or eliminating fatigue failure and/or thermal binding in the turbine attachment portion 103. Suitable compositions for the turbine rotor interface include materials having a coefficient of thermal expansion compatible with that of the rotor wheel material such as, but not limited to, metals, metal-alloys, or any combination thereof. The bucket interface includes any suitable composition for reducing or eliminating fatigue failure and/or thermal binding in the bucket attachment portion 102. Suitable compositions for the bucket interface include materials having a coefficient of thermal expansion compatible with that of the bucket material such as, but not limited to, ceramics, ceramic matrix composites (CMCs), metals, metal-alloys, or a combination thereof. Fatigue failure results from materials having differing thermal expansion values exerting pressures upon each other as temperatures increase. In another embodiment, tribological materials are positioned on the turbine rotor interface, the bucket interface, and/or mating faces between adjacent adaptors which are in contact, to minimize wear.

Each adapter 101 may include a wheelpost locking tab 111 and a dovetail locking tab 112. In one embodiment, insertion of a lockwire 113 in the wheelpost locking tab 111 retains the turbine attachment portion 103 to the wheelpost 107. The lockwire 113 in the wheelpost locking tab 111 reduces or eliminates axial movement of the adapter 101 relative to the turbine rotor 105. In another embodiment, insertion of the lockwire 113 in the dovetail locking tab 112 retains the root portion 108 of the turbine bucket 115 within the bucket attachment portion 102. The lockwire 113 in the dovetail locking tab 112 reduces or eliminates axial movement of the turbine bucket 115 relative to the adapter 101.

Referring to FIG. 2 and FIG. 3, in one embodiment, a plurality of the single blade adapters 201 and/or the multiple blade adapters 301 are slid into turbine rotor 105 over a plurality of the wheelposts 107 to form a segmented ring of adapters 101 around the turbine rotor 105. In another embodiment, the adapters 101 in the segmented ring include a wear couple 104 on a wear surface 114 of the adapter 101. The wear surface 114 is any surface of the adapter 101 that contacts, or comes into contact with, another one of the adapters 101 in the segmented ring. The wear couple 104 reduces or eliminates movement and/or friction between wear surfaces 114 of the adapters 101 of the segmented ring. In another embodiment, wear inserts are positioned to reduce friction between the turbine bucket 115 and the adapter 101.

In one embodiment, the wear surfaces 114 of the adapters 101 are designed to contact each other to permit reaction of bending loads at a pressure face 116 of the bucket attachment portion 102. In another embodiment, an anti-galling treatment is applied over the wear surfaces 114 of the adapters 101 that are designed to contact each other. The anti-galling treatment reduces or eliminates sticking and/or excessive friction between the wear surfaces 114, reducing or eliminating damage to the adapters 101 and/or turbine buckets 115. In another embodiment, the adapter 101 is a composite that includes fibers oriented to reduce or eliminate damage to the adapter 101 from friction between the wear surfaces 114. The orientation of the fibers is any suitable orientation for reducing friction, such as, but not limited to radial, circumferential, or a combination thereof.

Figure 4:
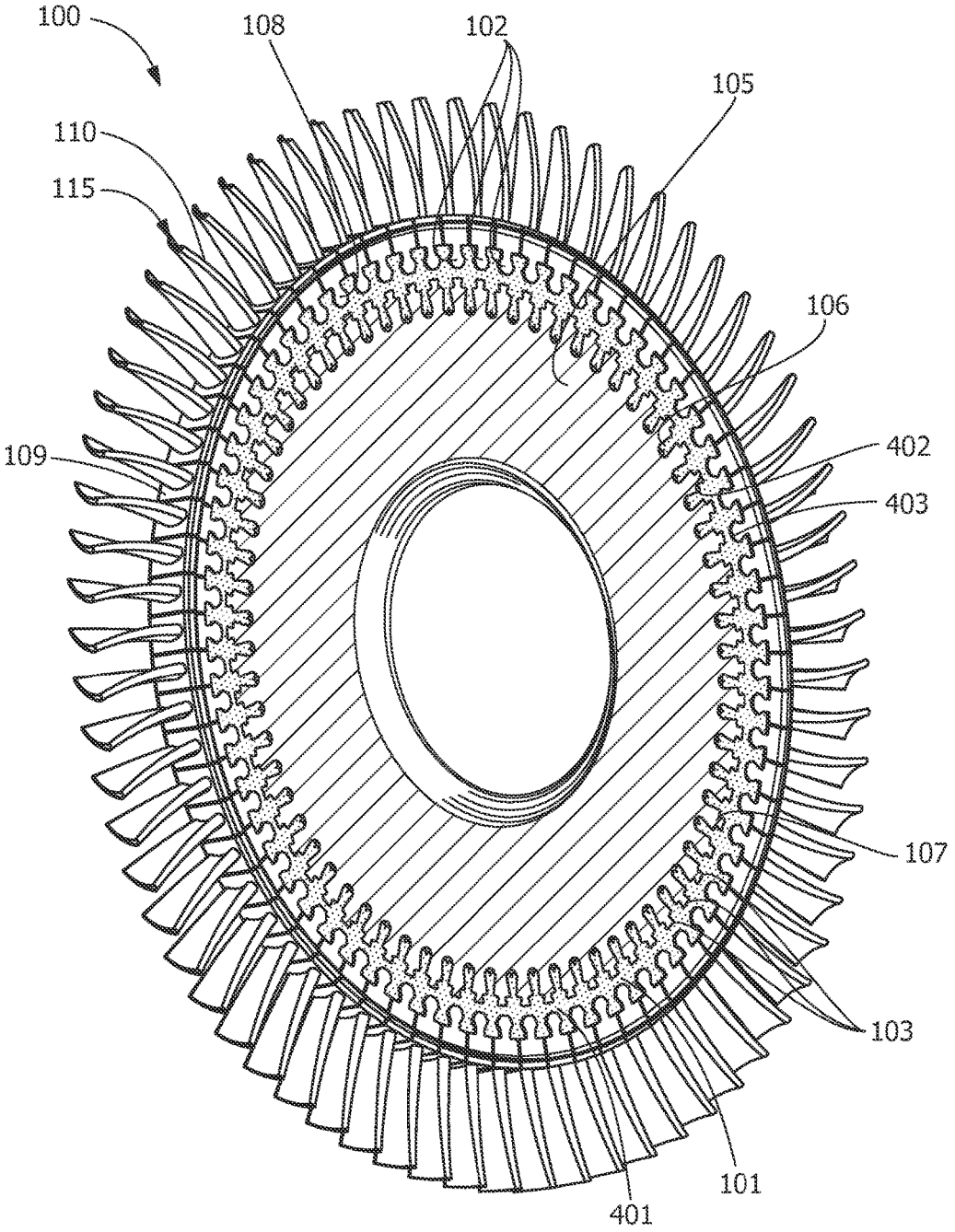
FIG. 4 is a perspective view of a retrofit turbine system, according to an embodiment of the disclosure.

Referring to FIG. 4, in one embodiment, the adapter 101 includes a full hoop segment 401 constructed as a single piece configured to be positioned around the turbine rotor 105. The turbine attachment portions 103 on an inner surface 402 of the full hoop segment 401 are slid into turbine rotor 105 over a plurality of the wheelposts 107. An outer surface 403 of the full hoop segment 401 provides the bucket attachment portions 102 for securing a plurality of the turbine buckets 115. The full hoop segment 401 permits any suitable conversion of the receiving portion 106 to the bucket attachment portion 102. Suitable conversions include, but are not limited to, axial to circumferential, axial to curved, straight axial to skewed axial, skewed axial to straight axial, or any combination thereof.

Referring to FIG. 1A-FIG. 4, in one embodiment, the turbine system 100 includes sliding at least one of the adapters 101 into the turbine rotor 105 over at least one of the wheelposts 107, then inserting at least one of the turbine buckets 115 into the bucket attachment portion 102 of the adapter(s) 101. In one embodiment, the turbine system 100 includes inserting at least one of the turbine buckets 115 into the bucket attachment portion 102 of at least one of the adapters 101, then sliding at least one of the adapters 101 into the turbine rotor 105 over at least one of the wheelposts 107. The adapter(s) 101 position the turbine bucket(s) 115 radially outward from the turbine rotor 105, as compared to the receiving portion(s) 106. Reducing the shank on the turbine bucket 115 maintains the length of the airfoil portion 110 similar or substantially similar to the airfoil portion 110 being replaced. Maintaining the length of the airfoil portion 110 maintains a similar or substantially similar flow path through the turbine system 100 as compared to the flow path of the airfoil portion 110 being replaced.

In one embodiment, the adapter 101 reduces or eliminates a cooling airflow to the turbine bucket 115. In another embodiment, the original turbine bucket 115 having a metal composition is replaced by the turbine bucket 115 having a non-metallic composition. The non-metallic composition has an increased temperature capability as compared to the metal composition, which permits a reduced or eliminated cooling airflow in the turbine bucket 115 at an operating temperature of the turbine system 100. Temperature capability, as used herein, refers to the materials' ability to operate at current or increasing temperatures with an acceptable decrease in mechanical properties for the given operating conditions under which the material operates.

In another embodiment, the adapters 101 and the turbine buckets 115 are provided with cooling channels to further increase operating temperature capability. In one embodiment, the cooling flow provided by the cooling channels is similar or substantially-similar to the cooling flow of existing metallic buckets, but preferably is less than that of the existing metallic buckets. The non-metallic buckets provide increased temperature capabilities with reduced cooling flow, providing increased cooling air for other purposes.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An adapter comprising:

a single turbine attachment portion on a first mating side of the adapter, the single turbine attachment portion having a first geometry arranged to contact and receive a corresponding geometry of a single wheelpost of a turbine rotor comprising a plurality of wheelposts comprising the single wheelpost, the plurality of wheelposts defining and separating a plurality of receiving portions of the turbine rotor; and a single bucket attachment portion on a second mating side opposite the first mating side, the single bucket attachment portion having a second geometry arranged to receive and retain a corresponding geometry of a single root portion of a single non-metallic turbine bucket comprising the single root portion.

2. The adapter of claim 1, wherein the single turbine attachment portion having the first geometry comprises a turbine rotor interface.

3. The adapter of claim 1, wherein the single bucket attachment portion having a second geometry comprises a bucket interface.

4. The adapter of claim 1, wherein the single bucket attachment portion is arranged to receive the second geometry of the single non-metallic turbine bucket, wherein the second geometry corresponds to a zero skew angle dovetail.

5. The adapter of claim 1, wherein the single bucket attachment portion is arranged to receive the second geometry of the single non-metallic turbine bucket, wherein the second geometry corresponds to a non-zero skew angle dovetail.

6. The adapter of claim 1, wherein the single bucket attachment portion is arranged to receive the second geometry of the single non-metallic turbine bucket, wherein the second geometry corresponds to a curved dovetail.

7. The adapter of claim 1, comprising a wheelpost locking tab in the single turbine attachment portion.

8. The adapter of claim 1, comprising a dovetail locking tab in the single bucket attachment portion.

9. The adapter of claim 1, comprising a lockwire for axial retention in the single turbine attachment portion and the single bucket attachment portion.

10. The adapter of claim 1, comprising a wear couple on at least one of the first mating side and the second mating side of the adapter.

11. The adapter of claim 1, comprising a wear resistant coating applied over at least one of the first mating side and the second mating side of the adapter.

12. An adapter comprising:

a plurality of turbine attachment portions on a first mating side of the adapter, each of the plurality of turbine attachment portions being arranged to contact and receive one of a plurality of wheelposts of a turbine rotor, the plurality of wheelposts defining and separating a plurality of receiving portions of the turbine rotor; and a plurality of bucket attachment portions on a second mating side opposite the first mating side, each of the plurality of bucket attachment portions being arranged to receive and retain a single dovetail root portion of one of a plurality of non-metallic turbine buckets having the single dovetail configuration root portions;

wherein the plurality of turbine attachment portions are equal in number to the plurality of bucket attachment portions.

13. The adapter of claim 12, further comprising material selected from the group consisting of metal, ceramic, ceramic matrix composite, intermetallic material and metal matrix composite.

14. A turbine system comprising:

a turbine rotor wheel configured to receive metal buckets, the turbine rotor wheel comprising a plurality of wheelposts defining and separating a plurality of receiving portions of the turbine rotor;

at least one adapter contacting, receiving, and secured to at least one wheelpost of the plurality of wheelposts of the turbine rotor wheel on a first mating side of the at least one adapter; and at least one non-metallic bucket having a root portion secured to the at least one adapter on a second mating side of the at least one adapter opposite the first mating side;

wherein the at least one adapter radially aligns each of the root portions with one of the at least one wheelpost; and wherein the at least one non-metallic bucket is selected from the group of materials consisting of ceramic, ceramic matrix composite, intermetallic material, and metal matrix composite.

15. The turbine system of claim 14, wherein the at least one adapter positions the at least one non-metallic bucket radially outward from the turbine rotor wheel.

16. The turbine system of claim 15, wherein the at least one non-metallic bucket comprises a short shank bucket.

17. The turbine system of claim 16, wherein a flow path of the turbine system remains unchanged.

18. The turbine system of claim 17, wherein the metal buckets further comprise a fir tree-type root portion.

19. The turbine system of claim 17, wherein the at least one adapter reduces a cooling air flow of the turbine system.

20. The turbine system of claim 17, wherein the at least one adapter is resistant to bending moments applied to the at least one non-metallic bucket.

* * * * *